US005881502A

United States Patent [19]

Tamlyn

[11] Patent Number: 5,881,502

[45] Date of Patent: Mar. 16, 1999

[54] VENTILATION STRIP FOR VENEER FINISHED BUILDINGS

[76] Inventor: John Thomas Tamlyn, 10406 Cash Rd., Stafford, Tex. 77477-4492

[21] Appl. No.: 862,576

[22] Filed: May 23, 1997

[51] Int. Cl.[6] ..... E04B 7/00

[52] U.S. Cl. ..... 52/94; 52/95

[58] Field of Search ..... 52/94, 95, 96, 52/459, 460, 480, 302.1

[56] References Cited

U.S. PATENT DOCUMENTS 4,461,128 7/1984 Knoebl .
4,580,374 4/1986 Quinnell .

FOREIGN PATENT DOCUMENTS 159 932 3/1954 Australia .

*Primary Examiner*—Creighton Smith
*Attorney, Agent, or Firm*—Gunn & Associates, P.C.

[57] ABSTRACT

The present disclosure is directed to a vent strip for a soffit made of two or more serially arranged boards. When assembled, the soffit boards define a central gap closed by this vent strip having perforations therealong to enable breathing through said vent strip; the vent strip also includes an edge located U-shaped receptacle to enable the vent strip to grip or clasp the adjacent serial soffit board(s). The second edge supports an L-shaped bracket to enable the vent strip to be latched over the wall veneer.

21 Claims, 1 Drawing Sheet

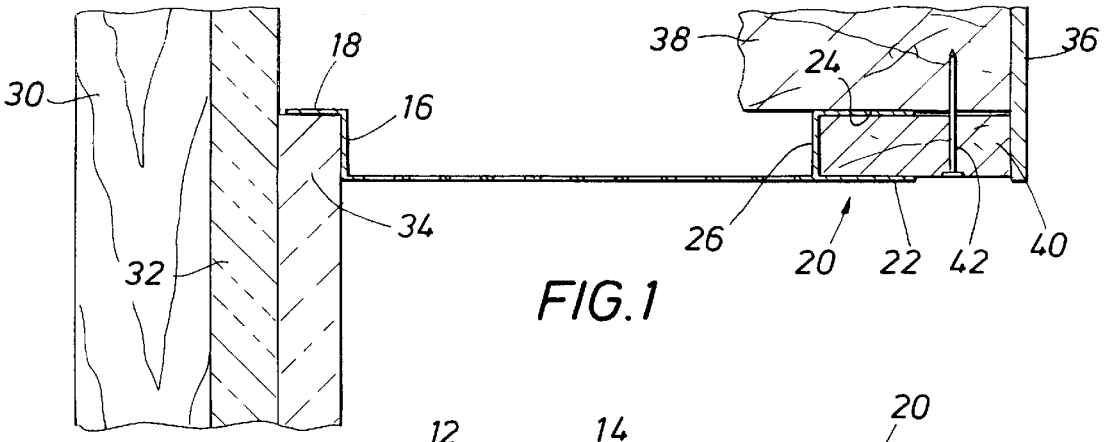
FIG. 1
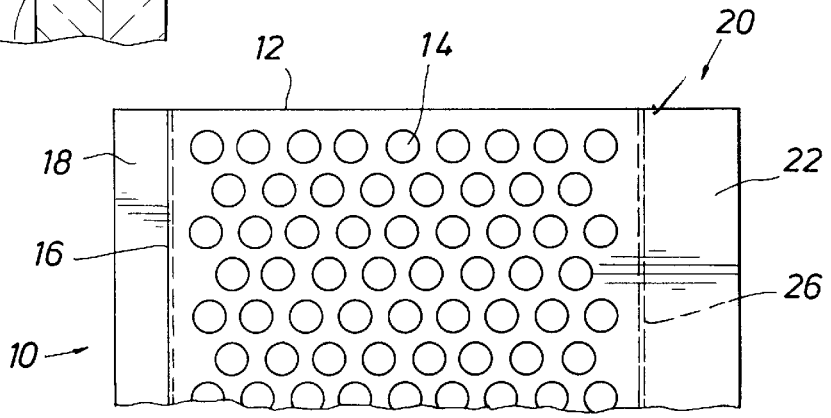
FIG. 2
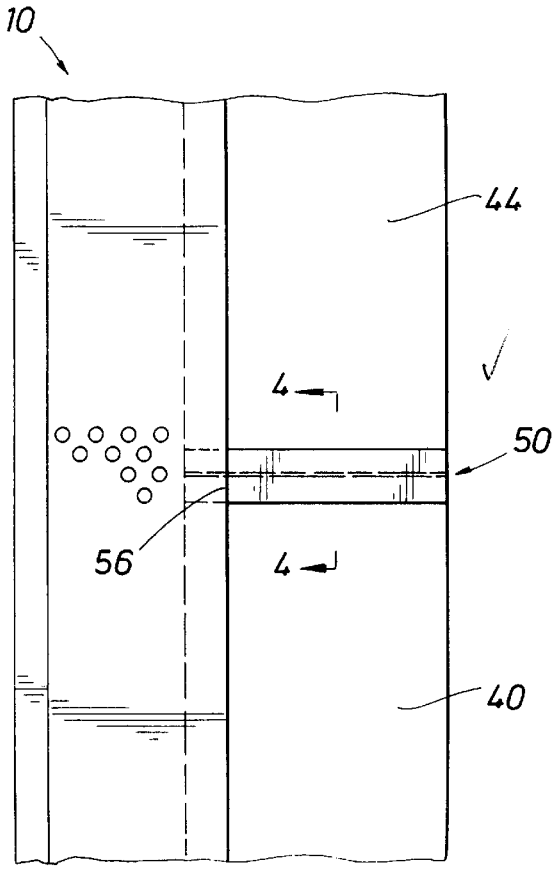
FIG. 3
FIG. 4
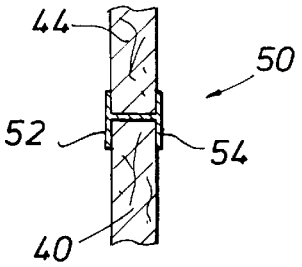

VENTILATION STRIP FOR VENEER FINISHED BUILDINGS

BACKGROUND OF THE DISCLOSURE

The present disclosure is directed to a ventilation strip which is used under the eaves to provide attic ventilation. Air circulation through the attic of a building is most helpful in reducing the heat load. Especially in southern states, it is highly desirable to maintain an air flow through the attic area. This requires both an air flow inlet and outlet. While the outlet might be a typical turbine ventilator located at the crown of the roof, it is often desirable (even essential) to locate a ventilation opening along the eaves. When located on the bottom side of the eaves, sheltered from blowing rain, an air inlet can be defined which permits flow of outside air through the attic spaces to reduce the heat load in the summertime. While the outside air temperature can be as much as 100°, the temperature in a closed attic can soar to 150°, or even 180° F. By locating various air outlets at the high places in the attic, air can be removed and fresh outside air can be drawn in. The air circulation into the attic reduces humidity in the attic. When humidity is trapped and cannot escape, the moisture will degrade insulation in the attic area. Therefore, it is helpful to ventilate to reduce temperature and remove trapped moisture in the attic.

In the past, eaves have been provided with air inlet strips. One procedure has been the construction of the underside of the eave which is known as the soffit with a gap and the gap is normally closed with aluminum, wire mesh. The aluminum wire mesh is typically nailed or stapled in place. The present disclosure sets forth a better mechanism for installing a ventilation strip along the side of a building. It can be installed in short lengths or can be as long as the side of the building, easily as much as 100' in length. The eave is typically constructed with an overhang of about 8" to about 24". While they can be different from the specified range, it is commonplace to have an eave of that width and any length. The construction of the soffit area under the eave, however, is in large part impacted by the nature of the finish of the building. In particular, most residential construction has a type of veneer exterior. For instance, the framing of the building will typically be defined by a set of 2×4 framing members which are erected defining the walls with windows, etc. The exterior will typically be covered with a sheet of insulation such as a weatherproofed layer of fiberboard. On the exterior of that, another layer will typically be attached. One example for a framed wooden structure is attachment of horizontal 1×6's to provide a typical wooden exterior. Cedar shingles of different sizes can be attached. It is also not uncommon to attach a brick veneer layer. The brick veneer can have different thicknesses. For instance, the veneer can be relatively thin or it can be standard brick thickness, i.e., a single course of bricks stacked in rows with mortar between the bricks. Another approach has been attachment of a relatively thin layer of a fiber-cement board material which is relatively heavy in structure and is quite strong, thereby permitting a relatively thin veneer. The fiber-cement composite material features imbedded cellulose fibers for lateral strength and is formed of a concrete slurry which is cured. It is molded with a specified profile on it, thereby avoiding the necessity of later painting. It is normally painted to match some color scheme for wood, having a very good wood planking appearance.

The present system sets forth a vent which is installed under the eave and which cooperates with the veneer on the exterior of the building. It defines a strip of specified width.

The strip presents a set of breathing holes or openings which are uniformly spaced. Ideally, the strip is formed of an extruded plastic vinyl of modest thickness and specified width. A typical width is about 2" although it can be made with different widths. Along one marginal edge positioned toward the structure, the device includes an L-shaped leg which enables that edge to abut against the veneer on the structure. The veneer sometimes is topped with a 1×4 board. The opposing marginal edge is constructed with a locking channel defined by three walls at right angles and the channel has a depth and width sized to fit over the soffit board. The soffit board is sometimes wood but more often, it is made of particle board, plywood or other composite materials. The most desirable soffit material is the fiber-cement material discussed elsewhere. Preferably, the soffit board is made relatively thin because it is not a load bearing structure. It is relatively thin, typically in the range of about ¼" to ½" in thickness. Conveniently, the locking channel can be made to a rectangular or square dimension enabling the channel to clamp on the marginal edge of the soffit. The vent strip of the present disclosure is fabricated in standard lengths. The lengths can vary, thereby permitting easy trimming to odd lengths. Standard lengths are typically about 8', 10' or 12' in length. Two or more separate units can simply be abutted in constructing a very long eave with a vent strip in accordance with the present invention.

The soffit vent construction of this disclosure has the advantage of attaching relatively easily. It can attach without the mandatory use of mains, screws or staples. When the soffit board is formed of the fiber-cement material, nails and similar fasteners are not desirable; the snap in receptacle is most easily engaged for assembly to avoid nails. The soffit vent strip has a width with a depth of attachment which enables overlapping and hiding of irregular cut edges. Typically, it abuts against a soffit board which may have to be trimmed. In using a saw to trim a long soffit board, the cut may wander somewhat. Variations in width are hidden in the unique double leg receptacle of the fastener along the edge. It defines a gap which permits the channel to hold the edge of the soffit board even where it is cut in some irregular fashion. That is normally covered. Moreover, it is attached to the soffit board without use of fasteners such as nails or staples. This is highly desirable. At the opposite edge, it laps over the top veneer strip (often called a brick frieze strip) and secures at the top edge of the veneer finish on the building. This is done even with a building constructed of any type of veneer material including those mentioned above. The vent system of the present disclosure therefore attaches quickly and easily, reducing the difficulties in fabrication. Moreover, it is chemically neutral and has no long term detrimental effect in cooperation with any type of veneer material. Care must be exercised in certain types of veneer materials. For instance, the fiber-cement sheet material is sensitive to aluminum when contact is made. That is avoided with the present vent strip. Rather, the vent strip of this disclosure is chemically inert and will not react negatively with any type of veneer including brick, wood or other planking. Last of all, it provides a distinctly more attractive product. When inspected, even years after installation, it will provide a high quality appearance. It provides a colorfast decorative strip which can be tailored to a particular paint scheme.

The present disclosure is summarized as a vent strip for attachment to an exposed eave. It is formed of an extruded continuous profile of plastic material having a profile enabling easy installation without screws, staples or nails. On one edge, it is provided with an L-shaped bracket which overhangs the veneer attached to the exterior of a building (e.g., the brick frieze strip). This enables easy installation at the topmost level of the veneer. The center portion is a wide span having a set of formed holes in it to provide breathing. The aggregate cross-sectional area is quite large, thereby furnishing the necessary breathing area. At the marginal right edge, it is constructed with a locking channel having three sides. The channel has a width and height sufficient to lock snugly against the soffit board. Multiple strips can be installed serially to provide a ventilation breathing space along the entire eave of a residential construction.

One big advantage of the installation derives from the edge location of the vent strip along one side of the soffit board. The soffit board is selected for a particular width so that long cuts are reduced in number. Many vents require two cuts in the soffit while this vent strip can be installed with one cut; indeed, by apt selection, the soffit board may not require any cutting.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may add to other equally effective embodiments.

FIG. 1 is a sectional view of the vent strip of the present disclosure installed under an eave adjacent to a veneer building finish;

FIG. 2 is a bottom view looking up at the vent strip of FIG. 1 which shows the breathing spaces in the vent strip;

FIG. 3 shows two abutting soffit boards cooperative with the present vent strip; and FIG. 4 is a sectional view showing the abutting board.

DETAILED DESCRIPTION OF THE PREFERRED EMBODIMENT

Attention is now directed jointly to FIGS. 1 and 2 which show the ventilation strip 10 of the present disclosure. The strip 10 is shown alone in FIG. 2 while it is shown installed in FIG. 1. The installation of FIG. 1 provides the context or its location. That will further enhance the explanation of the structure of the ventilation strip. Briefly, going to the strip itself, it is constructed in specified widths and indefinite lengths. A representative width includes a vent area of about 2" with marginal edges making a total strip width of about 3" or so. That particular embodiment likely will find substantial commercial significance. The ventilated area of about 2" in width is flanked on the marginal edges of widths of something more than ¼" ranging up to about ⅜" or even ½" depending on the size of the edges. More specifically, the strip includes a central area 12 which is provided with a number of perforations 14. The perforations can be relatively uniform and are arranged in rows and columns. While round is shown, other shapes such as squares or diamonds are useful. The perforations remove in the range of 40% to 65% of the surface area so that that much breathing area is provided. The perforations are located only at the center planar portion 12. The strip is constructed with a veneer shoulder meaning a shoulder on the left which is adapted for locking over (1) the veneer finish on the building wall, (2) the brick frieze strip, or (3) the framing member of the wall. This shoulder includes a wall 16 perpendicular to the plane of FIG. 2. This shoulder 16 is also shown in FIG. 1. A top lip 18 is located at the edge of the shoulder 16 to reach over the veneer as will be explained in detail with a representative installation. In cross-sectional view as shown in FIG. 1, they define an L-shaped latching member. This holds one edge of the equipment in place.

The right side of the ventilation strip 10 is defined by a U-shaped receptacle. This receptacle 20 is defined by three side walls. The three walls include the visible wall 22 shown in FIG. 2, the parallel wall 24 shown in FIG. 1, and the transverse wall 26. The shoulder 26 is at right angles to the walls 22 and 24. The shoulder 26 is parallel to the shoulder 16. It is desirable, but not required, that the shoulders 16 and 26 be formed with a common height.

The spaced shoulders 16 and 26 both serve as a butting shoulders. They define the width of the ventilation area. Moreover, they are adapted to be contacted against components of the structure which will be detailed in FIG. 1. The ventilation strip 10 is typically formed of extruded vinyl and has a length which is specifically long enough. The length is adequate in length so that one or more units of the ventilation strip 10 can be installed under an eave. They are simply deployed end-to-end in putting the eave structure together. The ventilation strip is preferably formed of an extruded vinyl having the illustrated cross-section and is perforated while being extruded. Typically, the thickness is a few mils, ranging typically from about 3 mils to about 12 mils in thickness. If the ventilation area is about 2" in width, the aggregate width is somewhere between about 2.5 and 3.0". A larger version can be made and if the width is increased, it is ideal to increase slightly the thickness to provide enhanced stiffness. It is desirable that the strip be able to flex or bow when squeezed between the two edges. That will be explained in regard to the installation of the strip. The strip is formed of a uniform colored material such as light tan, eggshell white, or perhaps some other off white. Also, gray will suffice. Generally, the vent strip is extruded of vinyl plastic mixed with a pigment or dye in the feed. This provides a color all the way through the extruded plastic. In the alternative, the strip can be extruded with one color and coated with other colors. It is normally installed at an area on a residential construction where it is seldom noticed. While not conspicuous to visual inspection, it is nevertheless exposed for viewing and it maintains its color, shape and decorative nature throughout an extended installation of 20 years or more. Because it is not exposed directly to sunlight, and is not exposed to the ultraviolet rays from the sun, aging, having the form of minor cracks accompanied by embrittlement, is less likely to occur. In reality, some of that may be reflected from the earth's surface and back scattered against the strip which might cause very slow aging. Even, however, with aging, the strip can maintain a quality ventilation area in an eave without requiring replacement for many years. Generally, plastic surfaces, exemplified by PVC and many other plastics, are susceptible to ultraviolet radiation which cracks the plastic. Paint reduces radiation damage. Generally, metal screen strips do not last that long through oxidation, etc. Moreover, the strip is also easier to clean once installed. It typically can be brushed with a broom.

Going now to FIG. 1 of the drawings, FIG. 1 shows the context in the construction of a building. The sequence of the building assembly may differ. This may also change the time at which the strip is fastened to the partially finished building. From the left side of FIG. 1, the numeral 30 identifies a typical vertical framing member. Commonly, this is a 2×4 which is erected on spaced centers, typically ranging between 16" and 24" spacing. It is erected to define the outside wall of the building. After that, the outside is commonly covered by 4×8 sheets of some sort of covering material 32, e.g., plywood, Styrofoam asphalt sheets, etc. Typically, this is a sheet of insulative material. The amount, thickness, and precise nature varies depending on the climate and the amount of insulation required. It is, however, installed after the framing. The framing is thus clad in this material. At some point in the construction of the building, an exterior building veneer is attached. The veneer can comprise any number of covering materials including cedar shingles, horizontal wood planking, vertical wood planking, a brick veneer of a selected thickness, and other covering materials. Fiber-cement materials are also used. The veneer material is typically added in rows or planks moving from the bottom toward the top of the wall. The topmost course 34 of the veneer can typically be, as mentioned, one of those products. The veneer member 34 is near the top of the wall, normally at the top or overlapping and exposed along the overhang. The important aspect of this particular installation is that the veneer material is extended up the wall and extends into the region of the eave so that it covers the wall. The underside of the overhang or the soffit region of the eave is at right angles to the topmost course of the veneer 34. Assume, for purposes of discussion, that the veneer material is a course of veneer bricks which are 1" in thickness. Again, this is representative and is not meant to limit. The topmost course of bricks 34 is attached in the common fashion. Again, if wood planking, it is attached by placing nails through the veneer 34 and into the frame member 30. Without regard to the precise details regarding fabrication, the topmost veneer member 34 is affixed and defines an upwardly facing shoulder which is used to support the L-shaped mounting bracket along the edge. As shown in FIG. 1 and ultimately accomplished in installation, the shoulder 16 butts up against the veneer and the offset left marginal edge 18 is latched or portioned marginally over the top of the veneer. More will be given regarding that.

The residential construction typically places a roof with an overhang extending well beyond the veneer 34. The overhang is defined by an outer facia surface 36. The surface 36 is typically spaced perhaps 8" to 24" from the veneer 34. This overhang keeps direct rain from falling against most of the wall. This enhances the life of the veneer material. This reduces air conditioning costs by shading the windows. It reduces or delays weathering of the plastic strip significantly. The facia board 36 is constructed at the outer ends of the rafters (not shown) defining the pitch of the roof and is the terminal end of lookout boards. The several lookout boards are arranged parallel to one another and at right angles to the ledger which are part of the house frame. It is common to assemble the joists and rafters at the time of framing the house, i.e., at the time of erecting the frame members 34. This enables several different craftsmen to have access so that they can work on the house simultaneously. In part, it is somewhat dependent on the climate, namely, whether the inclement weather and rain pose a problem, but it is not uncommon that the joists 38 and the rafters defining the roof are placed on the framed building quickly so that some kind of roof covering material can be placed as quickly as possible. That is placed on the house so that it is weathered in, i.e., the open framed building, even without wall covering, can shelter workmen who are out of the elements at the time. In any event, the eave, defined by the roof overhang, is constructed with the rafters and joints 38 in place. One step of this fabrication sequence is to then attach the soffit board 40. In this particular instance, the width of the soffit board can vary and it is shown with a broken line to indicate that it can be quite narrow or much wider. The soffit board is not a load bearing board. It is provided primarily to seal the eave area so that the roof and attic area are isolated to prevent small animal entry. Also, the soffit enhances appearance. The soffit board, therefore, need not be a heavy framing member. Rather, it is typically a thin sheet. Typically, it can be formed of particle board, plywood or the fiber-cement combination material previously mentioned. That typically will define a soffit of about ½" in thickness or less. An optimum is in the range of about ¼" thickness. That thickness is noteworthy because the thickness of the soffit 40 is related to the shoulder 26 on the vent strip 10. Ideally, the soffit 40 matches the thickness of the shoulder 26. The soffit board (two or more butting boards) is nailed to the lookout 38. A typical nail is indicated at 42. It is nailed to hold the soffit 40 in place. In view of the fact that it is light weight material because it is relatively thin, one or two courses of nails along the soffit driven into the overheat joists 38 is sufficient to hold the soffit in place. The nails or fasteners must comply with the building code for the locale. Ideally, the soffit is nailed to the lookout 38 so that there is a slight gap left between the soffit 40 and the overhead lookout 38. It is necessary to insert the lip of edge 24 of the receptacle 20 into the gap above the soffit 40 and below the lookout 38. If the lookouts are nailed too close to the soffit edge, they will tend to pinch or clamp against the vent strip 10 when it is installed and may prevent installation. Shim stock in the form of flat sheet stock is typically installed between the two. Alternatively, the nail 42 is driven home but it is not provided with the final blow which closes the soffit snugly against the lookout 38. The best nailing approach involves placing nails through soffit board into the lookout closer to the facia than the vent strip. In some instances, the soffit may be attached with pneumatically driven stapes. In that instance, it is optimum to place perhaps two rows of staples in the soffit board. One row of staples can be placed adjacent the facia 36, and the second row can be fastened in the soffit 40 after installation of the vent strip 10. That will help snug up the fit between the soffit 40 and the lookout 38. Again, this is a matter of technique and it can be varied from craftsman to craftsman (or region to region) to accomplish the desired result.

The soffit board is spaced in width from the veneer or frieze strip 34. The edge of the soffit 40 defines the gap or space which is to be filled by the vent strip 10. This space is therefore made uniform along the eave of the house. This requires that the soffit board be cut to the specified width. As shown in FIG. 1, the soffit is broken in the view so that it will be understood that the actual width of the soffit 40 can vary. Again, this is a matter of design and can be accommodated by the vent strip 10 of the present invention. At the time of installation, the vent strip is conveniently bowed by hand as the receptacle 20 is clamped against the edge of the soffit 40. This is done along the edge of the entire strip. Thereafter, the left hand edge is pushed up and over the veneer or frieze strip 34. It will be easy to see when the vent strip snaps into place to the illustrated position of FIG. 1. It is able to flex and bow in curvature. While bowed, the left and right edges which accomplish attachment are aligned so that the vent strip 10 can be moved into the position which is ultimately accomplished in FIG. 1. It is typically attached by attaching one edge completely and then attaching the other edge. It may be more desirable to attach the left edge first, not the right. In other installations, it may be desirable to do the right edge first. Once attached and snapped into place, nothing further is required of the vent strip. In typical construction sequences, it may, at that time, be desirable to put another row of nails or another row of staples in the soffit board 40. Again, this is a sequence of construction which can be varied depending on the desires of the craftsmen. The soffit board has a length, as mentioned, which can be the length of the building. Likewise, the vent strip 10 can be installed in multiple units. If furnished in 8' lengths, they can be installed serially. Odd lengths can be accommodated simply by using a pair of tin shears to cut the vent strip to any desired length.

When finished, a ventilation into the attic area is provided. The holes 14 provide more than adequate breathing space. This ventilation is important to the operation of the house and seems to provide enhanced lift to attic and roofing materials. Moreover, ventilation through the vent strip 10 is accomplished with the benefit of an attractive under eave construction. Such attic ventilation extends life so much that many shingle makers require attic air ventilation.

Attention is now directed to FIG. 3 of the drawings. There, the vent strip 10 is shown on the left hand side. This is a view looking up at the bottom of the soffit. The soffit, in this particular instance, is assembled with first and second soffit boards 40 and 44. The boards 40 and 44 collectively define the soffit which can extend the full length of the structure. Indeed, two, three or four similar boards can be arranged in butting relationship so that the soffit construction is consummated. The soffit, whether formed of one or several boards, is moved into the facing receptacle 20 along the edge of the vent strip 10. This is illustrated in FIG. 3. Without regard to the length of the vent strip 10 are the assembled soffit, proper and adequate length is obtained by this form of joining the components together. It is desirable that the gap between the boards 40 and 44 be closed. In the past, that has been closed with chalking. Chalking ultimately ages and becomes somewhat brittle. When that occurs, the gap between the boards 40 and 44 may bow open ever so slightly. Especially with wood, there may be come warpage or shrinkage. The present disclosure provides an enhanced protective strip as will be described.

FIG. 3 shows an enlarged view of the boards 40 and 44. They are closed at the gap between the two board with an H-shaped insert 50. The insert 50 is located between the two boards. It has a top face 52, and a bottom face 54. The two faces are joined by a central web 56. The web 56 is preferably as tall as the two boards so that it then defines left and right receptacles for the boards 40 and 44. It is located between the boards and has a length which is equal to the width of the soffit boards 40 and 44. It is desirable that it extend to the vent strip but not under it. In the region 56, the H-shaped member 50 is full length while the vent strip is cut only at the receptacle walls 22 and 24. The top and bottom exposed faces 52 and 54 both abut against the vent strip but do not create a ripple in or bulge under the vent strip.

While the foregoing is directed to the preferred embodiment, the scope thereof is determined by the claims which follow.

I claim:

1. A vent strip assembly under an eave of a roof overhang on a building comprising:

(a) an elongate soffit board parallel to a wall of the building;

(b) an outside surface veneer parallel to the elongate soffit board and comprised of external veneer members parallel to and spaced from the elongate soffit board;

(c) wherein said elongate soffit board and said surface veneer define a gap there between under an eave overhanging the wall of the building; and (d) a vent strip attached without fasteners between said elongate soffit board and said surface veneer, wherein said vent strip has soffit board engaging means therealong enabling engagement with said soffit board, and wherein said vent strip enables air circulation therethrough into a space above said vent strip.

2. The apparatus of claim 1 wherein said vent strip is constructed with an edge located U-shaped receptacle, and said vent strip is temporarily flexed to engage said U-shaped receptacle with said soffit board.

3. The apparatus of claim 2 wherein said U-shaped receptacle has a length equal to said vent strip.

4. The apparatus of claim 3 wherein said vent strip has two edges and one thereof supports said receptacle therealong to enable releasable engagement with said soffit board.

5. The apparatus of claim 4 wherein said vent strip has a uniform cross-sectional profile along the length thereof.

6. The apparatus of claim 4 wherein said vent strip has a second edge located L-shaped bracket to releasably engage an upper edge of said surface veneer.

7. The apparatus of claim 1 including an L-shaped bracket formed of two right angle members overlapping an upper edge of said veneer parallel to and spaced from said soffit board.

8. The apparatus of claim 7 wherein said soffit board is formed of two or more joints which form a butt joint and having a common thickness and said L-shaped bracket includes a right angle member having the same thickness.

9. The apparatus of claim 8 wherein said L-shaped bracket is formed of two members of equal width.

10. The apparatus of claim 9 wherein said L-shaped bracket is equal in length to said soffit board engaging means.

11. A soffit assembly on a lower side of an overhanging eave of a building comprising:

(a) a downwardly facing soffit formed of one or more soffit boards arranged along an overhanging eave;

(b) an upright wall extending upwardly under the eave and located parallel to said soffit to define a gap there between; and (c) a vent strip fitting in said gap and comprising:

(1) a central, perforate, elongate vent portion having two lengthwise edges;

(2) an overlocking, edge mounted co-extensive clamping member to engage wall attachment by temporarily flexing said vent strip;

(3) a second edge mounted co-extensive, soffit engaging receptacle having a width enabling said soffit to extend into said receptacle by temporarily flexing said vent strip and clamp therealong and (4) an L-shaped clamping member, and a U-shaped receptacle having two parallel, equal length legs in cross section along said edges.

12. The apparatus of claim 11 wherein said soffit comprises at least two butting soffit boards wherein each of said soffit boards fits in said receptacle.

13. The apparatus of claim 12 including an H-shaped insert between said soffit boards.

14. The apparatus of claim 13 wherein said H-shaped inset fits against said vent a strip.

15. A vent strip assembly under an eave of a roof overhang on a building comprising:

(a) an elongate soffit board parallel to the wall of the building;

(b) an outside surface veneer parallel to the elongate soffit board and comprised of external veneer members parallel to and spaced from the elongate soffit board;

(c) wherein said elongate soffit board and said surface veneer define a gap there between under an eave overhanging the wall of the building;

(d) a vent strip between said elongate soffit board and said surface veneer wherein said vent strip has soffit board engaging means therealong enabling engagement with said soffit board, and wherein said vent strip enables air circulation therethrough into a space above said vent strip; and (e) said strip includes (1) an edge located U-shaped receptacle;

(2) a second edge located L-shaped bracket to releasably engage an upper edge of said surface veneer.

16. The apparatus of claim 15 wherein said U-shaped receptacle has a length equal to said vent strip.

17. The apparatus of claim 15 wherein said vent strip has a uniform cross-sectional profile along the length thereof.

18. The apparatus of claim 15 wherein said L-shaped bracket is formed of two right angle members overlapping the upper edge of said veneer parallel to and spaced from said soffit board.

19. The apparatus of claim 18 wherein said soffit board is formed of two or more joints which form a butt joint and having a common thickness and said L-shaped bracket includes a right angle member having the same thickness.

20. The apparatus of claim 19 wherein said L-shaped bracket is formed of two members of equal width.

21. The apparatus of claim 20 wherein said L-shaped bracket is in length to said soffit board engaging means.

* * * * *